US005856781A

United States Patent [19]

Michel et al.

[11] Patent Number: 5,856,781

[45] Date of Patent: Jan. 5, 1999

[54] REFRIGERATOR DOOR ALARM SYSTEM

[76] Inventors: Warren K. Michel; Gerrard Cheramie, both of H 205 E. 37 Pl., Cutoff, La. 70345

[21] Appl. No.: 79,830

[22] Filed: May 15, 1998

[51] Int. Cl.[6] ..... G08B 13/08

[52] U.S. Cl. ..... 340/547; 340/585; 340/686; 340/692; 340/693.5; 62/129; 62/131

[58] Field of Search ..... 340/545, 546, 340/547, 585, 692, 693, 686; 62/129, 131

[56] References Cited

U.S. PATENT DOCUMENTS

| | | | |
|---|---|---|---|
| 4,241,337 | 12/1980 | Prada | 340/547 |
| 4,463,348 | 7/1984 | Sidebottom | 340/585 |
| 4,528,558 | 7/1985 | Steers et al. | 340/686 |
| 4,566,285 | 1/1986 | Tershak et al. | 340/585 |
| 4,691,195 | 9/1987 | Sigelman et al. | 340/545 |
| 4,707,684 | 11/1987 | Janke et al. | 340/530 |
| 4,835,520 | 5/1989 | Aiello | 340/545 |
| 4,894,643 | 1/1990 | Thompson et al. | 340/593 |
| 5,451,930 | 9/1995 | McDaniel | 340/521 |
| 5,479,152 | 12/1995 | Walker et al. | 340/545 |

*Primary Examiner*—Daniel J. Wu
*Attorney, Agent, or Firm*—Joseph N. Breaux

[57] ABSTRACT

A refrigerator door alarm system that includes a message circuit having a playback function that is triggered by a trigger circuit that detects movement of the magnetic gasket of the refrigerator door. The refrigerator door alarm system includes an alarm housing and an alarm circuit including a trigger circuit, a timer circuit responsive to the trigger circuit, a message circuit responsive to the trigger circuit, and a buzzer responsive to the timer circuit. The alarm housing includes an outwardly extended magnetic attachment side strip secured to an attachment strip support, a speaker grate, a buzzer grate, a message record button opening, a message play button opening, a battery compartment, and a magnetically actuated reed switch assembly member; the trigger circuit including a magnetically actuated reed switch that is activatable by the magnetic field oat a magnetic refrigerator door gasket. The refrigerator door alarm system audibly outputs the recorded message on the speaker each time the trigger circuit is triggered. The refrigerator door alarm system generates an audible buzzer output when the timer circuit runs past a predetermined door open time. The door open time is measured from the triggering of the trigger circuit.

1 Claim, 2 Drawing Sheets

REFRIGERATOR DOOR ALARM SYSTEM

TECHNICAL FIELD

The present invention relates to alarm systems and message devices and more particularly to a refrigerator door alarm system that includes a message circuit having a playback function that is triggered by a trigget circuit that detects movement of the magnetic gasket of the refrigerator door; the refrigerator door alarm system including an alarm housing and an alarm circuit including a trigger circuit, a timer circuit responsive to the trigger circuit, a message circuit responsive to the trigger circuit, and a buzzer responsive to the timer circuit; the alarm housing including on outwardly extended magnetic attachment side strip secured to an attachment strip support, a speaker grate, a buzzer grate, a message record button opening, a message play button opening, a battery compartment, and a magnetically actuated reed switch assembly member; the trigger circuit including a magnetically actuated reed switch that is activatable by the magnetic field of a magnetic refrigerator door gasket; the timer IC having a timer input triggered by the change of state of the magnetic reed switch and a timer output in controlling connection with the buzzer; the buzzer producing an audible output in response to receiving a buzzer activation signal from the timer output of the timer circuit; the voice generating message circuit including a voice signal generating IC, a speaker, a play message button, and a record message button; the voice signal generating IC having a first playback input, a second playback input, a record input, and a voice signal output; the voice signal generating IC a) generating a voice signal to the speaker in response to receipt of a play signal from the play message button, b) generating a voice signal to the speaker in response to a change of state of the magnetically activated reed switch, and c) recording voice signal for playback in response to receipt of a record signal from the message activation button; the refrigerator door alarm system audibly outputting the recorded message on the speaker each time the trigger circuit is triggered; the refrigerator door alarm system generating an audible buzzer output when the timer circuit runs past a predetermined door open time; the door open time being measured from the triggering of the trigger circuit.

BACKGROUND ART

Loss of the contents of a freezer or refrigerator compartment of a refrigerator unit can often result from leaving the door ajar. Although the user is conscientious in trying to maintain the door in the closed position, it could be helpful to have an alarm that provided an audible output to attract the attention of the user to close the refrigerator door once a predetermined time period had elapsed. Because it is often difficult to install alarms and the like, it would be a benefit to have an alarm system that was enclosed in one housing and that could be installed simply by positioning the housing onto a surface of the refrigerator unit adjacent to the door to be monitored. In addition, because the refrigerator unit is often visited it would be a further benefit to have a refrigerator door alarm system that included a message playing mechanism for passing along message to occupants of the home by playing a user recordable audible message each time the monitored refrigerator door is opened.

GENERAL SUMMARY DISCUSSION OF INVENTION

It is thus an object of the invention to provide a refrigerator door alarm system that is easily installed.

It is a further object of the invention to provide a refrigerator door alarm system that provides an audible output to attract the attention of the user to close the refrigerator door once a predetermined time period has elapsed.

It is a still further object of the invention to provide a refrigerator door alarm system that includes a message playing mechanism for passing along a message to occupants of the home by playing a user recordable audible message each time the monitored refrigerator door is opened.

It is a still further object of the invention to provide a refrigerator door alarm system that includes a message circuit having a playback function that is triggered by a trigger circuit that detects movement of the magnetic gasket of the refrigerator door; the refrigerator door alarm system including an alarm housing and an alarm circuit including a trigger circuit, a timer circuit responsive to the trigger circuit, a message circuit responsive to the trigger circuit, and a buzzer responsive to the timer circuit; the alarm housing including an outwardly extended magnetic attachment side strip secured to an attachment strip support, a speaker grate, a buzzer grate, a message record button opening, a message play button opening, a battery compartment, and a magnetically actuated reed switch assembly member; the trigger circuit including a magnetically actuated reed switch that is activatable by the magnetic field of a magnetic refrigerator door gasket; the timer IC having a timer input triggered by the change of state of the magnetic reed switch and a timer output in controlling connection with the buzzer; the buzzer producing an audible output in response to receiving a buzzer activation signal from the timer output of the timer circuit; the voice generating message circuit including a voice signal generating IC, a speaker, a play message button, and a record message button; the voice signal generating IC having a first playback input, a second playback input, a record input, and a voice signal output; the voice signal generating IC a) generating a voice signal to the speaker in response to receipt of a play signal from the play message button, b) generating a voice signal to the speaker in response to a change of state of the magnetically actuated reed switch, and c) recording a voice signal for playback in response to receipt of a record signal from the message activation button; the refrigerator door alarm system audibly outputting the recorded message on the speaker each time the trigger circuit is triggered; the refrigerator door alarm system generating an audible buzzer output when the timer circuit runs past a predetermined door open time; the door open time being measured from the triggering of the trigger circuit.

It is a still further object of the invention to provide a refrigerator door alarm system that accomplishes some or all of the above objects in combination.

Accordingly, a refrigerator door alarm system is provided. The refrigerator door alarm system includes a message circuit having a playback function that is triggered by a trigger circuit that detects movement of the magnetic gasket of the refrigerator door; the refrigerator door alarm system including an alarm housing and an alarm circuit including a trigger circuit, a timer circuit responsive to the trigger circuit, a message circuit responsive to the trigger circuit, and a buzzer responsive to the timer circuit; the alarm housing including an outwardly extended magnetic attachment side strip secured to an attachment strip support, a speaker grate, a buzzer grate, a message record button opening, a message play button opening, a battery compartment, and a magnetically actuated reed switch assembly member; the trigger circuit including a magnetically actuated reed switch that is activatable by the magnetic field of a magnetic refrigerator door gasket; the timer IC having a timer input triggered by the change of state of the magnetic reed switch and a timer output in controlling connection with the buzzer; the buzzer producing an audible output in response to receiving a buzzer activation signal from the timer output of the timer circuit; the voice generating message circuit including a voice signal generating IC, a speaker, a play message button, and a record message button; the voice signal generating IC having a first playback input, a second playback input, a record input, and a voice signal output; the voice signal generating IC a) generating a voice signal to the speaker in response to receipt of a play signal from the play message button, b) generating a voice signal to the speaker in response to a change of state of the magnetically actuated reed switch, and c) recording a voice signal for playback in response to receipt of a record signal from the message activation button; the refrigerator door alarm system audibly outputting the recorded message on the speaker each time the trigger circuit is triggered; the refrigerator door alarm system generating an audible buzzer output when the timer circuit runs past a predetermined door open time; the door open time being measured from the triggering of the trigger circuit.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
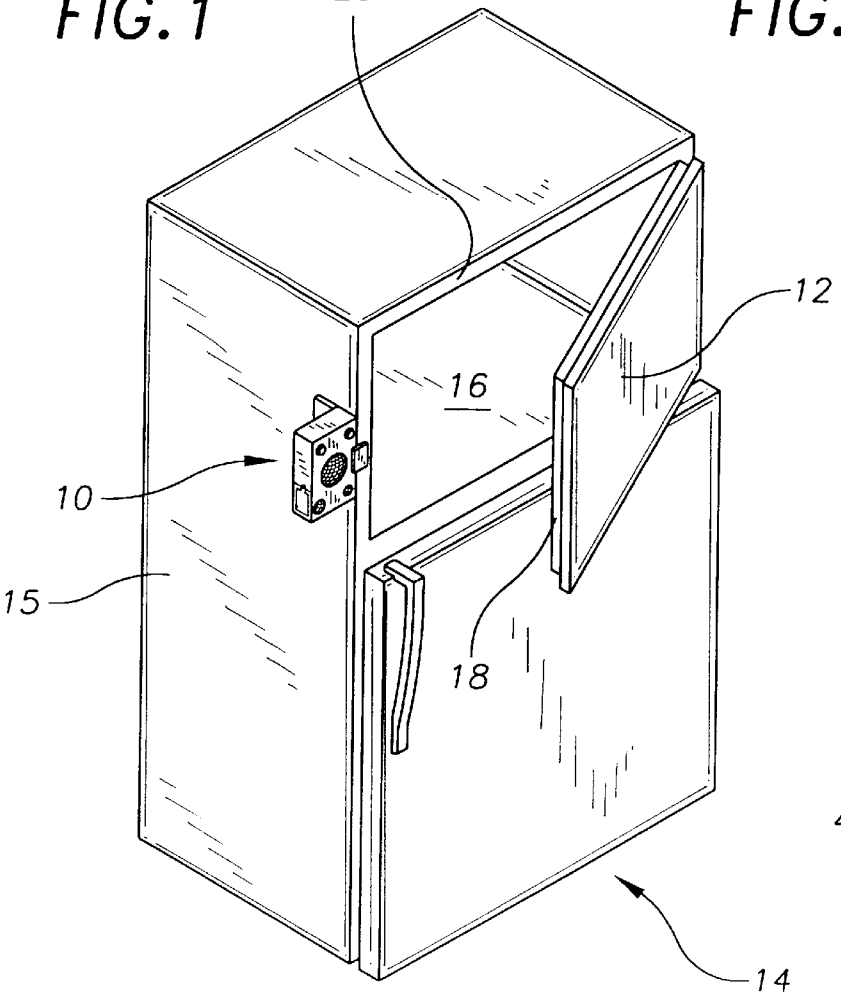
FIG. 1 is a perspective view showing an exemplary embodiment of the refrigerator door alarm system of the present invention installed in connection with the freezer door of an representative refrigerator.

FIG. 1 shows an exemplary embodiment of the refrigerator door alarm system of the present invention, generally designated 10, installed onto the refrigerator sidewall 15 adjacent to the freezer door 12 of a representative refrigerator unit, generally designated 14. Freezer door 12 seals the freezer compartment 16 and includes a magnetic sealing gasket 18 around the interior perimeter edge thereof for forming an airtight seal between freezer door 12 and the circumferential edge 20 defining the opening to freezer compartment 16.

Figure 2:
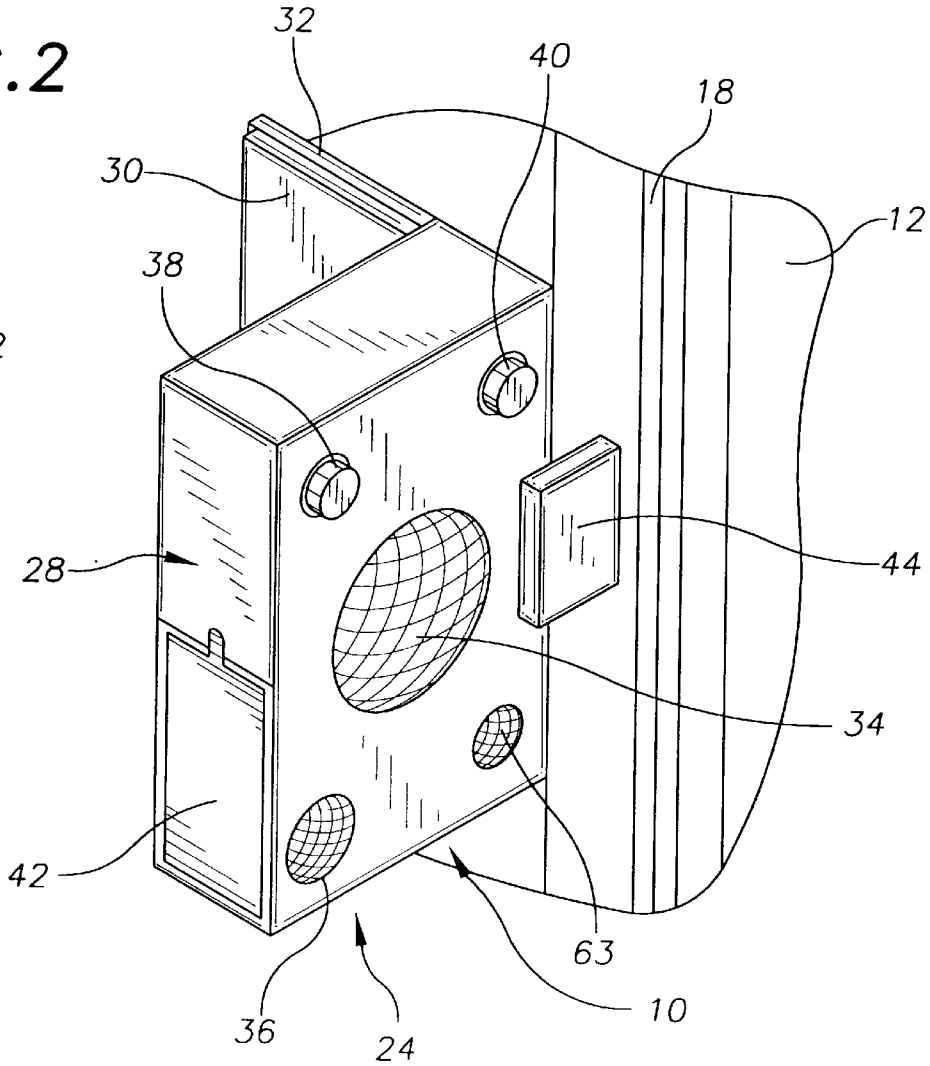
FIG. 2 is a perspective view of the exemplary refrigerator door alarm system of FIG. 1 showing the alarm system housing, the speaker grate, the buzzer grate, the record button, the play button, the battery compartment, and the magnetically actuated reed switch assembly.
Figure 3:
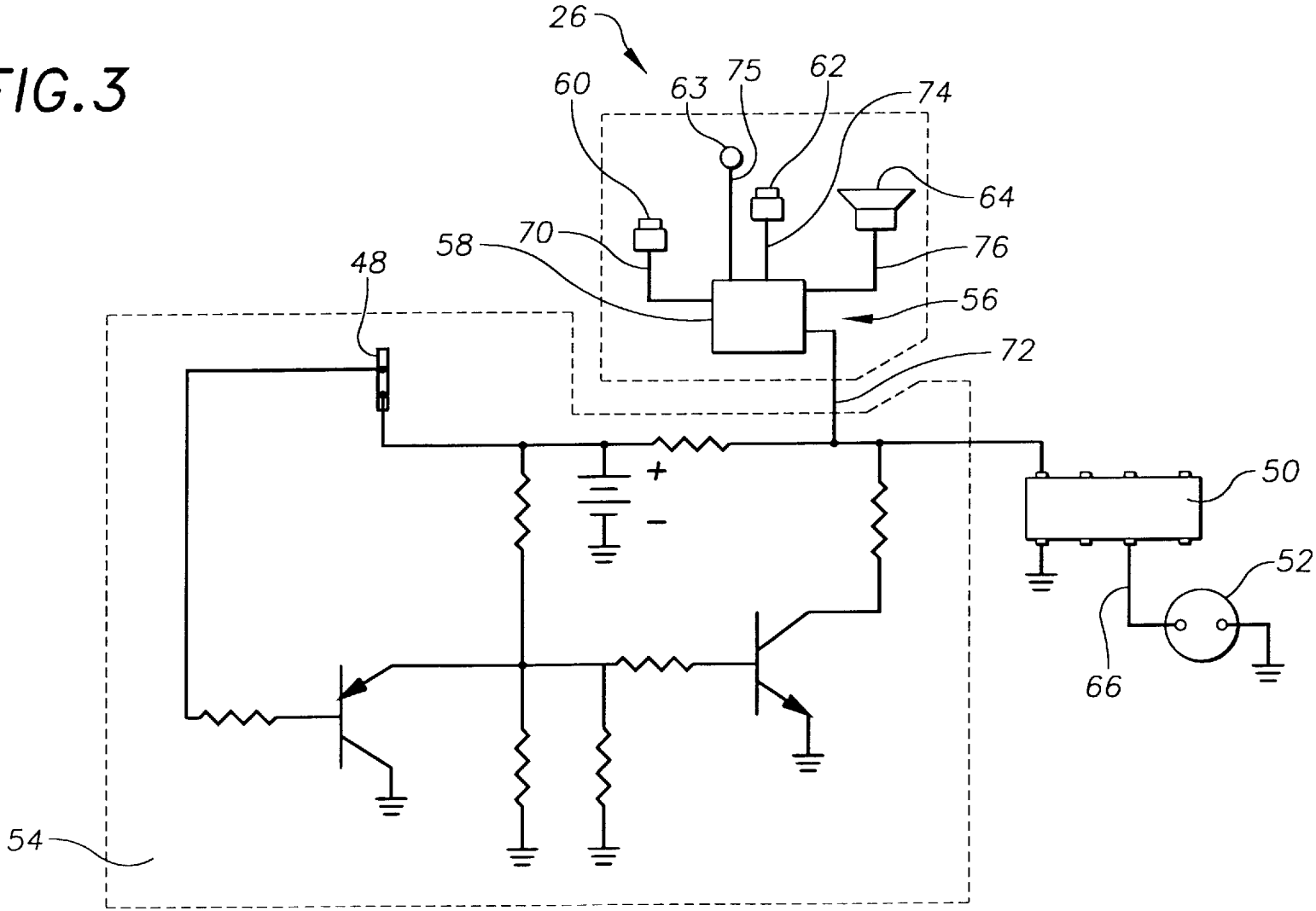
FIG. 3 is a schematic diagram of the alarm circuit of the refrigerator door alarm system of the present invention showing the timer IC, the buzzer, the trigger circuit including the reed switch, and the voice generating message circuit including the voice generating IC, the play button, the record button, and the speaker.

With reference now to FIG. 2, refrigerator door alarm system 10 includes a housing, generally designated 24, and an alarm circuit, generally designated 26 (FIG. 3). Housing 24 is of molded plastic construction and includes a rectangular circuit housing portion, generally designated 28 and an outwardly extended attachment strip support 30 upon which a magnetic attachment side strip 32 is secured. Magnetic attachment side strip 32 secures housing 24 to sidewall 15 of refrigerator unit 14. Circuit housing portion 28 includes a circuit compartment formed therein, a speaker grate 34, a buzzer grate 36, a message record button opening 38, a message play button opening 40, a battery compartment cover 42, and a magnetically actuated reed switch assembly member 44. Reed switch assembly member 44 contains a magnetically actuated reed switch 48 (FIG. 3) that forms part of alarm circuit 26 (FIG. 3). During installation of alarm system 10, reed switch assembly member 44 is positioned adjacent to magnetic gasket 18 of freezer door 12 to hold magnetically actuated reed switch 48 (FIG. 3) sufficiently close to magnetic gasket 18 to remain closed. When freezer door 12 is opened, magnetic gasket 18 is moved away and magnetically actuated reed switch 48 (FIG. 3) opens.

With reference to FIG. 3, alarm circuit 26 includes a convention 555 timer IC 50, a piezo electric buzzer 52, a trigger circuit 54 that includes magnetically actuated reed switch 48, and a voice generating message circuit, generally designated 56. Voice generating message circuit 56 includes a voice signal generating IC 58, a play button 60, a record button 62, a microphone 63 and a speaker 64. Voice signal generating IC 58 has a first playback input 70 in connection with play button 60, a second playback input 72 In connection with trigger circuit 54, a record input 74 in connection with record button 62, a microphone input 75 in connection with microphone 63 and a voice signal output 76 in connection with speaker 64. Voice signal generating IC 58 generates a voice signal to speaker 76 in response to receipt of a play signal from play message button 60; generates a voice signal to speaker 76 in response to detecting a change in state of magnetically actuated reed switch 48; and records a voice signal from microphone 63 in response to receipt of a record signal from record button 62.

In use voice generating message circuit IC 58 outputs a user recorded message each time play button 60 is depressed or magnetically actuated reed switch 48 is opened by opening freezer door 12 (FIG. 1,2) and moving magnetic gasket 18 (FIG. 1,2). The message can be changed by the user by depressing record button 62 end recording the message to be delivered by speaking into microphone 63. If magnetically actuated reed switch 48 is not closed before a predetermined time period has elapsed, timer IC 50 generates a time out signal on a timer output 66 to activate buzzer 52.

It can be seen from the preceding description that a refrigerator door alarm system has been provided that is easily installed; that provides an audible output to attract the attention of the user to close the refrigerator door once a predetermined time period has elapsed; that includes a message playing mechanism for passing along a message to occupants of the home by playing a user recordable audible message each time the monitored refrigerator door is opened; and that includes a message circuit having a playback function that is triggered by a trigger circuit that detects movement of the magnetic gasket of the refrigerator door; the refrigerator door alarm system including an alarm housing and an alarm circuit including a trigger circuit, a timer circuit responsive to the trigger circuit, a message circuit responsive to the trigger circuit, and a buzzer responsive to the timer circuit; the alarm housing including an outwardly extended magnetic attachment side strip secured to an attachment strip support, a speaker grate, a buzzer grate, a message record button opening, a message play button opening, a battery compartment, and a magnetically actuated reed switch assembly member; the trigger circuit including a magnetically actuated reed switch that is activatable by the magnetic field of a magnetic refrigerator door gasket; the timer IC having a timer input triggered by the change of state of the magnetic reed switch and a timer output in controlling connection with the buzzer; the buzzer producing an audible output in response to receiving a buzzer activation signal from the timer output of the timer circuit; the voice generating message circuit including a voice signal generating IC, a speaker, a play message button, and a record message button; the voice signal generating IC having a first playback input, a second playback input, a record input, and a voice signal output; the voice signal generating IC a) generating a voice signal to the speaker in response to receipt of a play signal from the play message button, b) generating a voice signal to the speaker in response to a change of state of the magnetically actuated reed switch, and c) recording a voice signal for playback in response to receipt of a record signal from the message activation button; the refrigerator door alarm system audibly outputting the recorded message on the speaker each time the trigger circuit is triggered; the refrigerator door alarm system generating an audible buzzer output when the timer circuit runs past a predetermined door open time; the door open time being measured from the triggering of the trigger circuit.

It is noted that the embodiment of the refrigerator door alarm system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A refrigerator door alarm system comprising:

an alarm housing: and an alarm circuit positioned within said alarm housing and including a trigger circuit, a timer circuit responsive to said trigger circuit, a voice generating message circuit responsive to said trigger circuit, and a buzzer responsive to said timer circuit;

said alarm housing including an outwardly extended magnetic attachment side strip secured to an attachment strip support, a speaker grate, a buzzer grate, a message record button opening, a message play button opening, a battery compartment, and a magnetically actuated reed switch assembly member;

said trigger circuit including a magnetically actuated reed switch positioned within said reed switch assembly member;

said magnetically actuated reed switch being activatable by a magnetic field from of a magnetic refrigerator door gasket;

said timer IC having a timer input triggered by a change of state of said magnetically actuated reed switch and a timer output in controlling connection with said buzzer;

said buzzer producing an audible output in response to receiving a buzzer activation signal from a timer output of said timer circuit;

said voice generating message circuit including a voice signal generating IC, a speaker, a play message button, and a record message button;

said voice signal generating IC having a first playback input, a second playback input, a record input, and a voice signal output;

said voice signal generating IC:

a) generating a voice signal to said speaker in response to receipt of a play signal from said play message button, b) generating a voice signal to said speaker in response to a detecting a change of state of said magnetically actuated reed switch of said trigger circuit, and c) recording a voice signal for playback in response to receipt of a record signal from said message record button;

said refrigerator door alarm system audibly outputting said recorded voice signal on said speaker each time said trigger circuit is triggered;

said refrigerator door alarm system generating an audible buzzer output when said timer circuit runs past a predetermined door open time;

said door open time being measured from said change of state of said magnetically actuated reed switch.

* * * * *